US008573129B1

(12) United States Patent
Smitchko

(10) Patent No.: US 8,573,129 B1
(45) Date of Patent: Nov. 5, 2013

(54) SELF SEALING FIREARM PROJECTILE

(76) Inventor: Daniel J. Smitchko, Morrisdale, PA (US)

( * ) Notice: Subject to any disclaimer, the term of this patent is extended or adjusted under 35 U.S.C. 154(b) by 151 days.

(21) Appl. No.: 12/985,901

(22) Filed: Jan. 6, 2011

Related U.S. Application Data

(60) Provisional application No. 61/293,022, filed on Jan. 7, 2010.

(51) Int. Cl.
*F42B 14/02* (2006.01)

(52) U.S. Cl.
USPC ..... 102/524

(58) Field of Classification Search
USPC ..... 102/524, 439, 525, 526, 527, 528
See application file for complete search history.

(56) References Cited

U.S. PATENT DOCUMENTS 143,419 A * 10/1873 Rein et al. ..... 102/524
711,209 A * 10/1902 Hill ..... 102/524
847,149 A * 3/1907 Barlow ..... 102/524
996,820 A * 7/1911 Wray ..... 102/524
1,582,673 A * 4/1926 Fahrenwald ..... 148/432
2,386,054 A * 10/1945 McGee ..... 244/3.1
4,958,570 A * 9/1990 Harris ..... 102/517
5,686,693 A * 11/1997 Jakobsson ..... 102/501
D456,480 S * 4/2002 Quinsa et al. ..... D22/116
7,210,411 B2 * 5/2007 Booth et al. ..... 102/514

* cited by examiner

*Primary Examiner* — Bret Hayes
(74) *Attorney, Agent, or Firm* — John J. Elnitski, Jr.

(57) ABSTRACT

A self sealing projectile having an adjustable sealing band about the projectile. The adjustable sealing band having the ability to deform and provide a seal between inside surfaces of the firearm and the projectile. The projectile includes a front receiving groove between the adjustable sealing band and the front end of the projectile, where the front receiving groove is in proximity to the adjustable sealing band to receive a portion of the adjustable sealing band during deformation of the adjustable sealing band. The projectile includes a rear receiving groove between the adjustable sealing band and the rear end of the projectile, where the rear receiving groove is in proximity to the adjustable sealing band to receive a portion of the adjustable sealing band during deformation of the adjustable sealing band.

13 Claims, 16 Drawing Sheets

SELF SEALING FIREARM PROJECTILE

This application claims the benefit of and incorporates by reference U.S. Provisional Application No. 61/293,022 filed Jan. 7, 2010.

BACKGROUND

The present invention generally relates to firearm projectiles. More specifically, the present invention relates to interaction between a firearm projectile and a rifle bore.

Some shooters of firearms prefer bullets machined from a solid material as opposed to jacketed bullets, especially for rifles. Gyroscopic stability problems are associated with jacketed bullets due to the core of the bullet not being located at the true axis of rotation of the bullet, as compared to precision machined solid bullets. Some firearms include rifling within the barrel of the firearm. Rifling is a series of grooves cut into inside diameter of the barrel. The remaining material between the grooves is knows as the lands. The lands are what remain between the grooves after the grooves are cut in the inside diameter of a blank barrel. Typically lead core, or jacketed bullets, are slightly undersize but when enough pressure is put behind them, they upset or swell somewhat to seal into the groove diameter of a barrel of a firearm. Groove diameter is the largest diameter inside the barrel of the firearm. That is why worn out barrels do not shoot well. The barrels get worn beyond what a jacketed bullet is capable of upsetting within to seal against the barrel. This may only be a few tenths of a thousandths but it is enough to have pressure escape around the bullet.

Machining monolithic bullets instead of forging bullets allows for maintaining a constant center of gravity. Unlike jacketed bullets, current solid bullets do not seal tightly in worn or even slightly worn rifle barrels due to the fact that the solid bullets do not upset or expand to seal the bullet into the rifle barrel grooves when fired. If the solid bullets are not "sealed" in the rifle grooves during firing, gasses escape around the bullet causing inaccuracies to be experience when using solid bullets in some guns. When there is no sealing between the solid bullet and the barrel there can also be loss of potential speed of the bullet as it leaves the barrel. Solid copper bullets do not upset to fill the groove diameter. If there is any wear in the barrel or if the barrel is made slightly oversize due to the manufacturing process, blow by is experienced using solid copper bullets. Blow by is where pressure escapes around the bullet. That is why people that have shot solid copper bullets in the past have not been able to shoot them consistently. Typically in shooting five solid copper bullets, you may get three or four with in a group and one or two that are not in the group of the other shots.

It is an object of the present invention to provide a solid bullet that can seal within a rifled barrel during firing.

SUMMARY OF THE INVENTION

A self sealing projectile having an adjustable sealing band about the projectile. The adjustable sealing band having the ability to deform and provide a seal between inside surfaces of the firearm and the projectile. The projectile includes a front receiving groove between the adjustable sealing band and the front end of the projectile, where the front receiving groove is in proximity to the adjustable sealing band to receive a portion of the adjustable sealing band during deformation of the adjustable sealing band. The projectile includes a rear receiving groove between the adjustable sealing band and the rear end of the projectile, where the rear receiving groove is in proximity to the adjustable sealing band to receive a portion of the adjustable sealing band during deformation of the adjustable sealing band.

DETAILED DESCRIPTION

Figure 1:
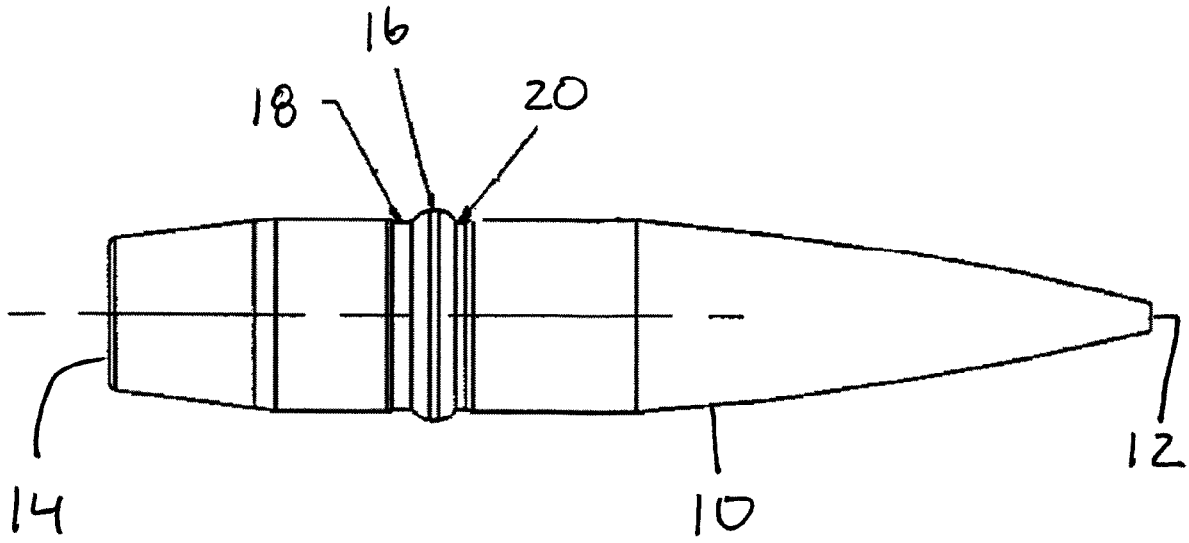
FIG. 1 is a side view of a self sealing projectile according to the present invention.

The present invention is a self sealing projectile 10 for a firearm, commonly referred to as a bullet. The self sealing projectile 10 is of a monolithic construction, which is the precise machining of a bullet from a solid material such as copper. FIGS. 1-16 show the self sealing projectile 10. The self sealing projectile 10 eliminates several problems associated with other solid bullet designs, as well as problems associated with lead core jacketed bullets. FIG. 1 shows the self sealing projectile 10 having a front end 12 and a rear end 14. The self sealing projectile 10 includes an adjustable sealing band 16, as shown in FIG. 1, which adjusts during firing by deforming. The adjustable sealing band 16 is larger than the caliber diameter band portion of the self sealing projectile 10, which is the designate caliber of the self sealing projectile 10. The caliber diameter band is the largest diameter of the bullet and is the specified diameter for the caliber of bullet being used that matches with the caliber specification of the firearm to be used with the bullet. The self sealing projectile 10 includes a rear receiving groove 18 behind the adjustable sealing band 16 and a front receiving groove 20 forward of the adjustable sealing band 16. The front receiving groove 20 and rear receiving groove 18 are each in proximity to the adjustable sealing band 16 to receive part of the adjustable sealing band 16 when the adjustable sealing band 16 is deformed. FIGS. 1-16 show the front receiving groove 20 and rear receiving groove 18 extending directly from the adjustable sealing band 16. Depending upon caliber of the barrel of the firearm, the adjustable sealing band 16 is in a range from 0.0002" to 0.006" larger than caliber diameter. The depth of front receiving groove 20 and rear receiving groove 18 is typically in a range of 0.002 to 0.010 inches smaller than the adjustable sealing band 16, which provides a groove smaller than the caliber diameter. The width of front receiving groove 20 and rear receiving groove 18 is typically in the range 0.010 to 0.050 inches wide. The adjustable sealing band 16 is used to eliminate the possibility the self sealing projectile 10 will not seal tightly in a worn or slightly worn rifle barrel, as well as new factory made barrels and custom made barrels. Current solid bullets without the adjustable sealing band 16 do not upset or expand in the barrel to seal the bullet into the grooves of the rifle barrel when fired.

Figure 2:
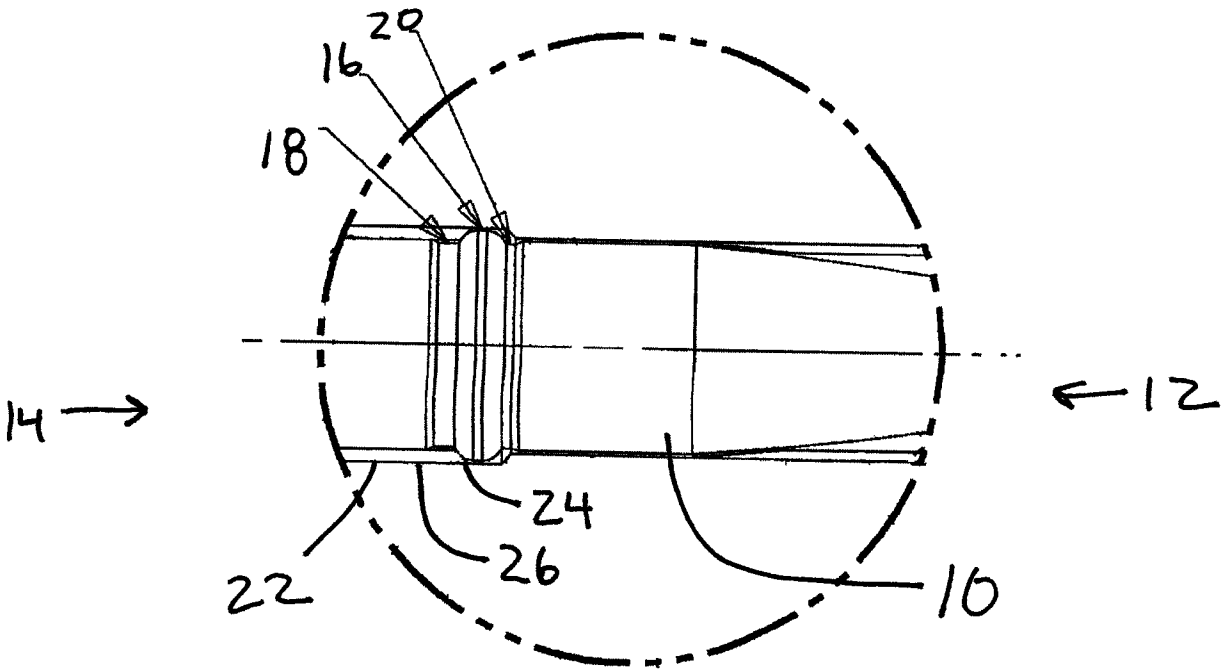
FIG. 2 is a partial cross sectional of a self sealing projectile according to the present invention.
Figure 3:
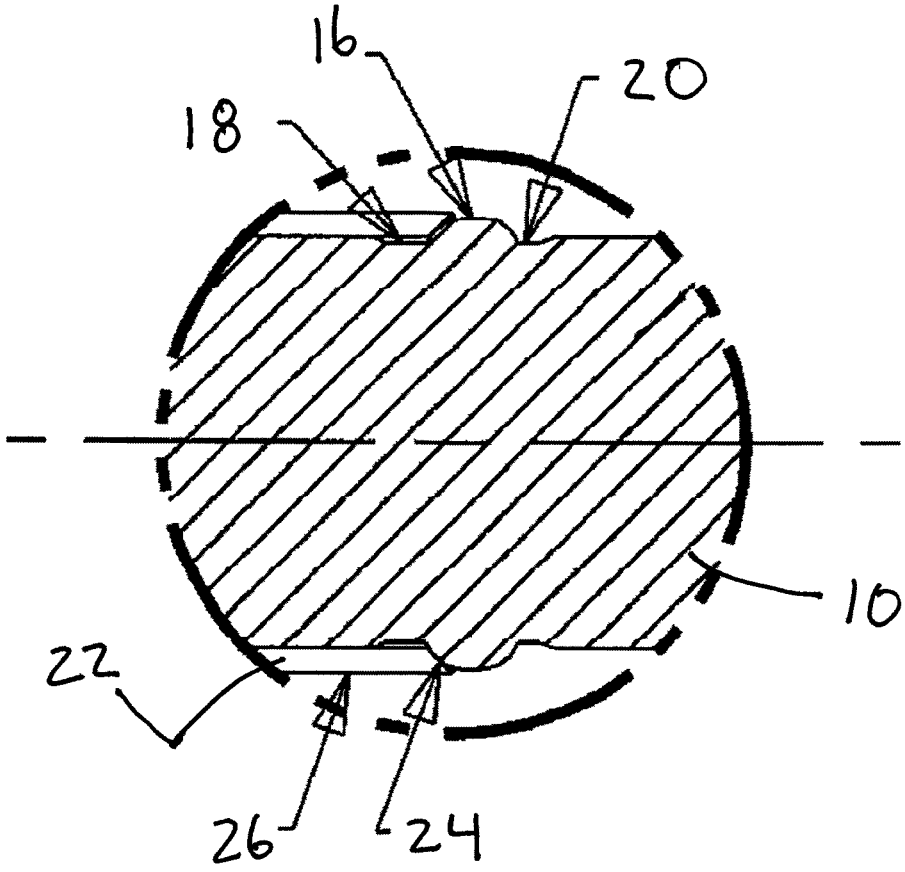
FIG. 3 is a partial side view of a self sealing projectile according to the present invention.

The self sealing projectile 10 is loaded into a cartridge casing 22 as shown in FIGS. 2-3 to a depth that seats the adjustable sealing band 16 into the mouth 24 of the case neck 26 at least one quarter of the width of the adjustable sealing band 16 or deeper. The adjustable sealing band 16 is positioned along the length of the bullet so the cartridge over all length ends up being correct for the shortest cartridge, based on chamber dimensions for various common cartridges in a certain caliber. For a cartridge having the maximum charge capacity, the adjustable sealing band 16 is positioned as far rearward as possible to allow the bullet to project from the case as far as practical, while allowing sufficient surface area to keep the bullet straight in the case. A good choice is a seventy-five percent of the caliber diameter for a minimum bearing length to ensure the bullet is held in the case securely. The bullets are manufactured by turning on a lathe or milling with a CNC machine.

The self sealing projectile 10 is projected from the cartridge when fired. The self sealing projectile 10 first enters a throat area 28 and then proceeds to the rifled barrel 30 after firing. The throat area 28 shown in FIGS. 4-16 is sometimes referred to as the LEAD and the throat. The LEAD is where the bullet first enters the throat area 28 and the throat is where the self sealing projectile 10 enters after passing the LEAD and before the self sealing projectile 10 enters the rifled barrel 30. When the adjustable sealing band 16 contacts the inside surfaces of a firearm, the adjustable sealing band 16 deforms to fit tightly within the rifled barrel 30 of the firearm and forms a seal between the self sealing projectile 10 and the rifled barrel 30. The seal forms between the self sealing projectile 10 and the rifled barrel 30 due to the deformation of the adjustable sealing band 16 and prevents the escape of gases from behind the self sealing projectile 10 during firing. The adjustable sealing band 16 will flow into both the front receiving groove 20 and the rear receiving groove 18, as the adjustable sealing band 16 is compressed and deformed due to contact with the inside surfaces of the firearm. Ideally the closer a bullet matches the groove diameter, which is the largest diameter inside the rifle barrel 30, the better the performance of the bullet. Having the adjustable sealing band 16 being larger than the groove diameter of a rifled barrel 30 makes a complete seal in the rifled barrel 30. The adjustable sealing band 16 will be formed to roughly the size of the rest of the self sealing projectile 10 in a rifled barrel 30 that is not worn or fills in the areas that are deficient in a worn rifled barrel 30.

There are two situations where the adjustable sealing band 16 contacts the inside surfaces of the firearm. The first situation involves two different types. The first type is where throat erosion occurs in firearms that are fired for thousands of rounds and therefore a tight seal does not occur at the throat area 28 between the adjustable sealing band 16 and the throat area 28. The second type is where production firearms typically have a throat area diameter of 0.002"-0.004" over the specified nominal throat diameter and therefore sealing does not occur at the throat area 28 between the adjustable sealing band 16 and the throat area 28. In these cases, the self sealing projectile 10 travels forward past the throat area 28 before the adjustable sealing band 16 engages the inside of the rifled barrel 30 and is deformed, as shown in FIGS. 4-16.

Figure 4:
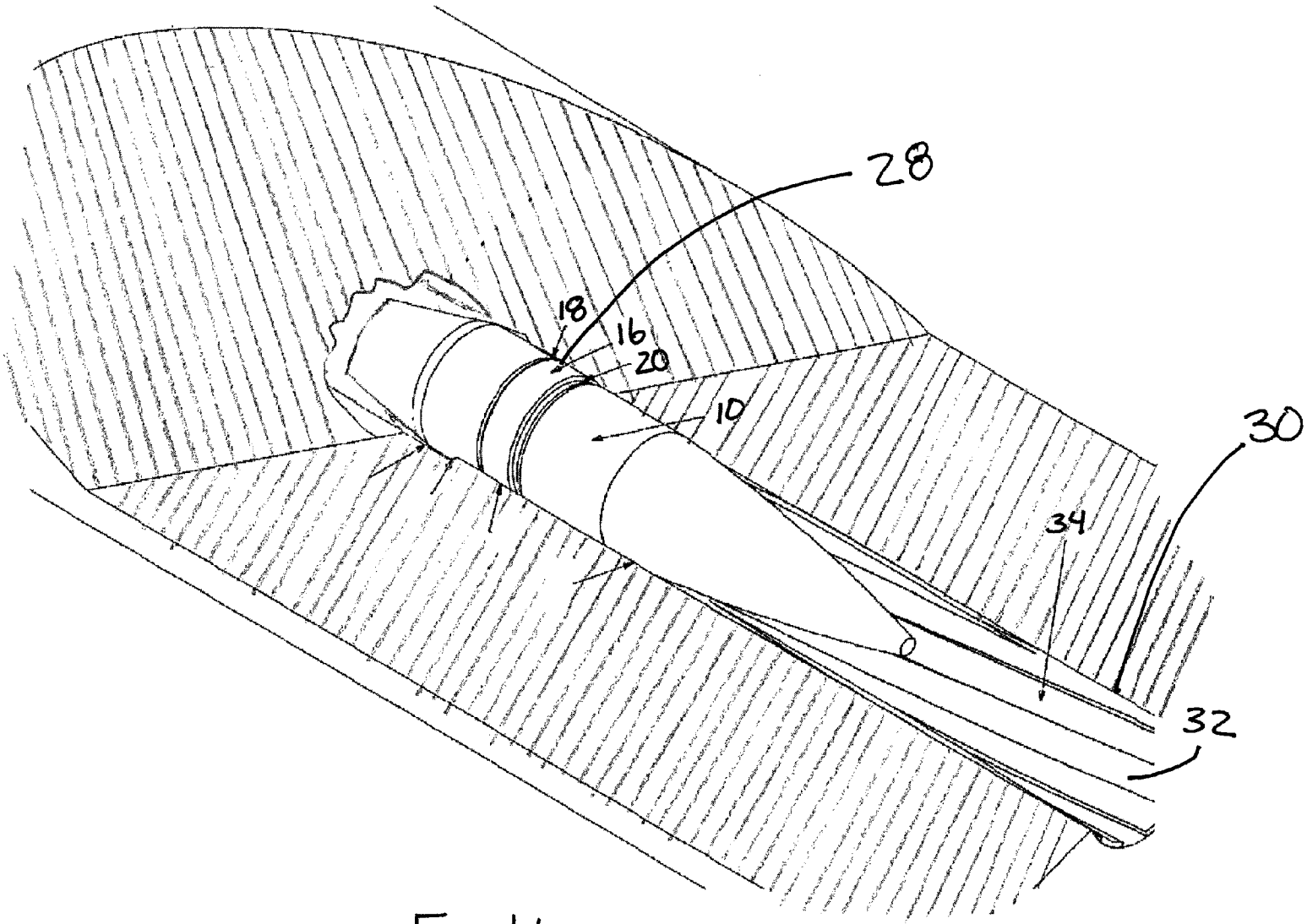
FIG. 4 is a perspective cutaway view of a self sealing projectile in a firearm according to the present invention.
Figure 5:
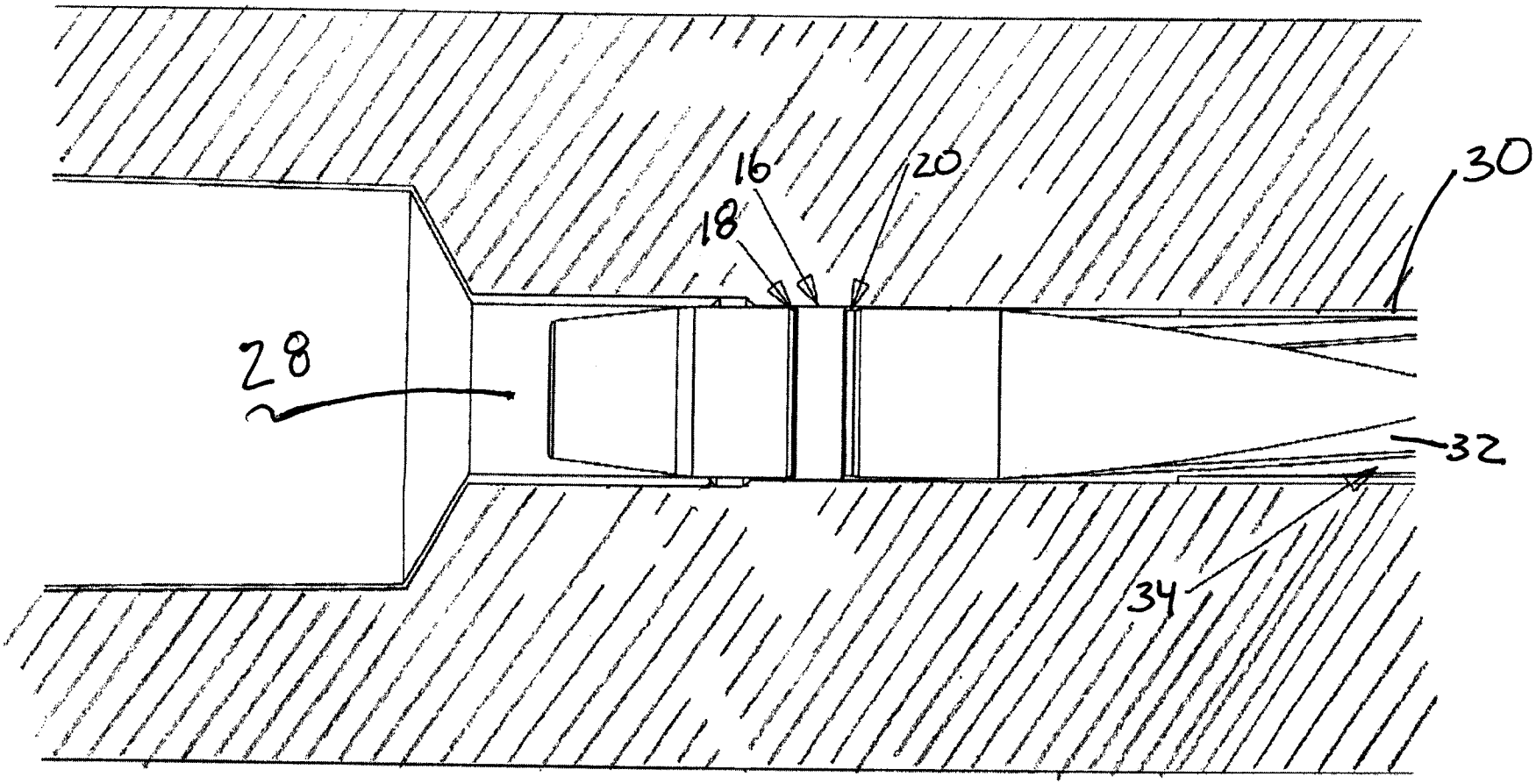
FIG. 5 is a side cutaway view of a self sealing projectile in a firearm according to the present invention.
Figure 6:
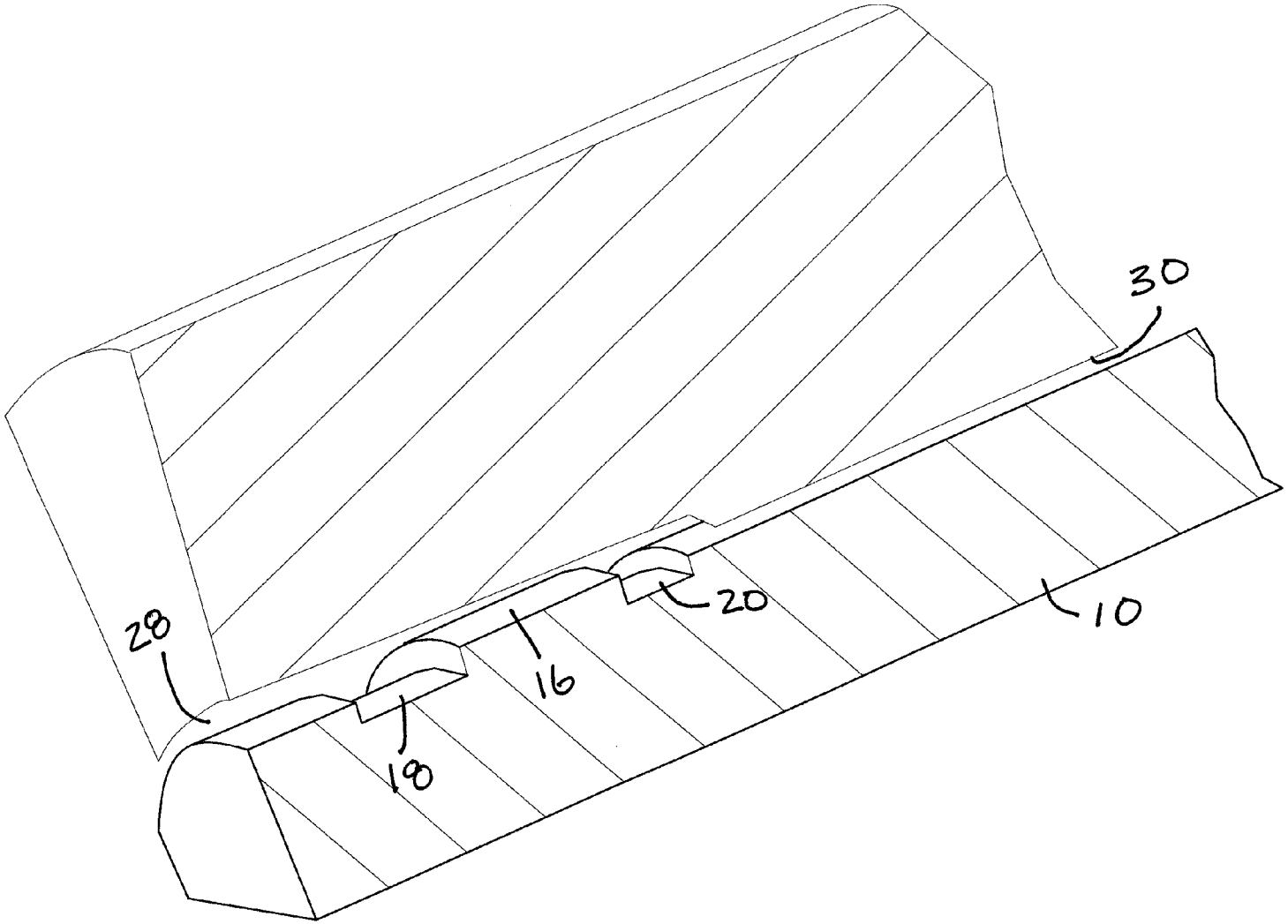
FIG. 6 is a perspective cutaway view of a self sealing projectile in a firearm according to the present invention.
Figure 7:
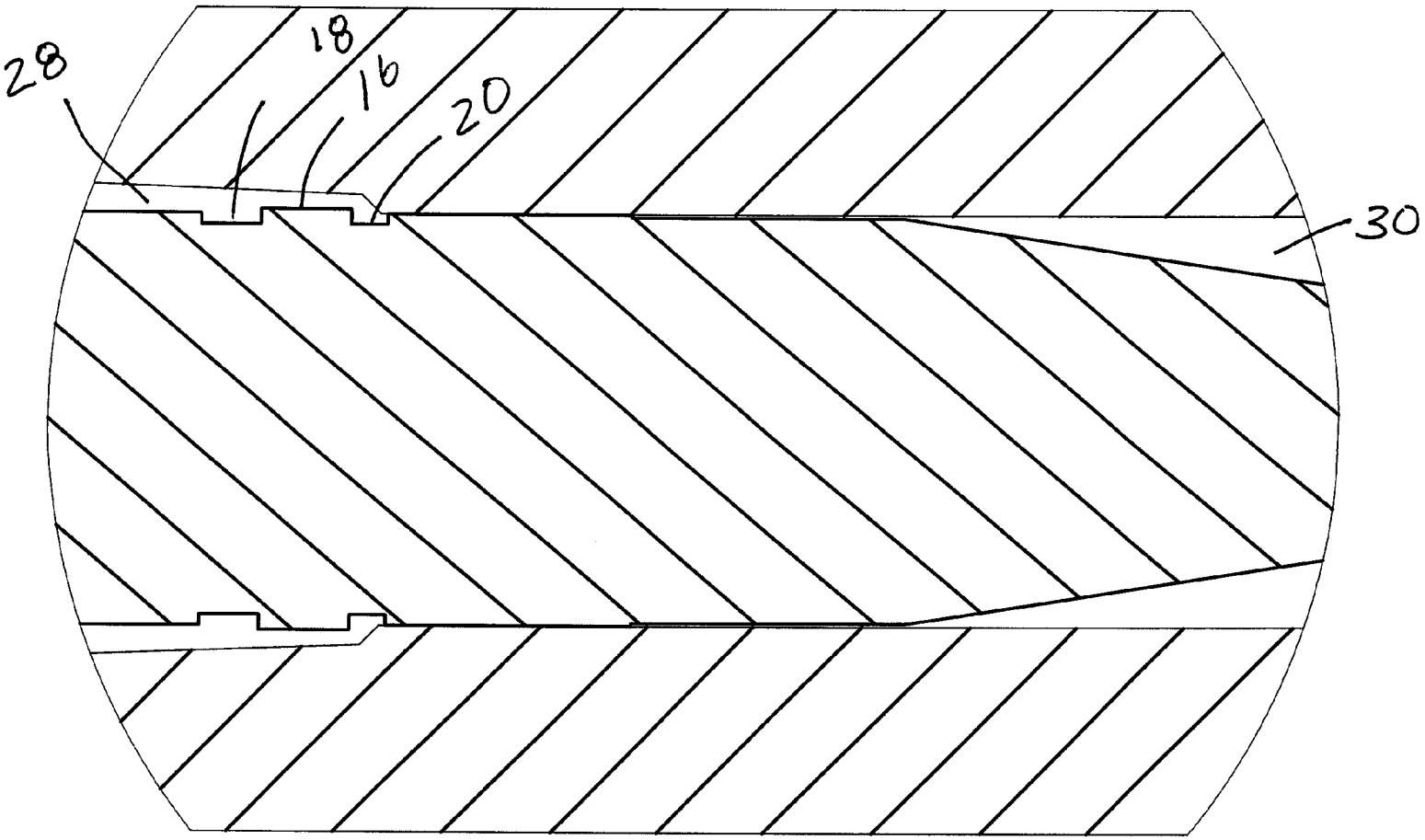
FIG. 7 is a cross sectional view of a self sealing projectile in a firearm according to the present invention.
Figure 8:
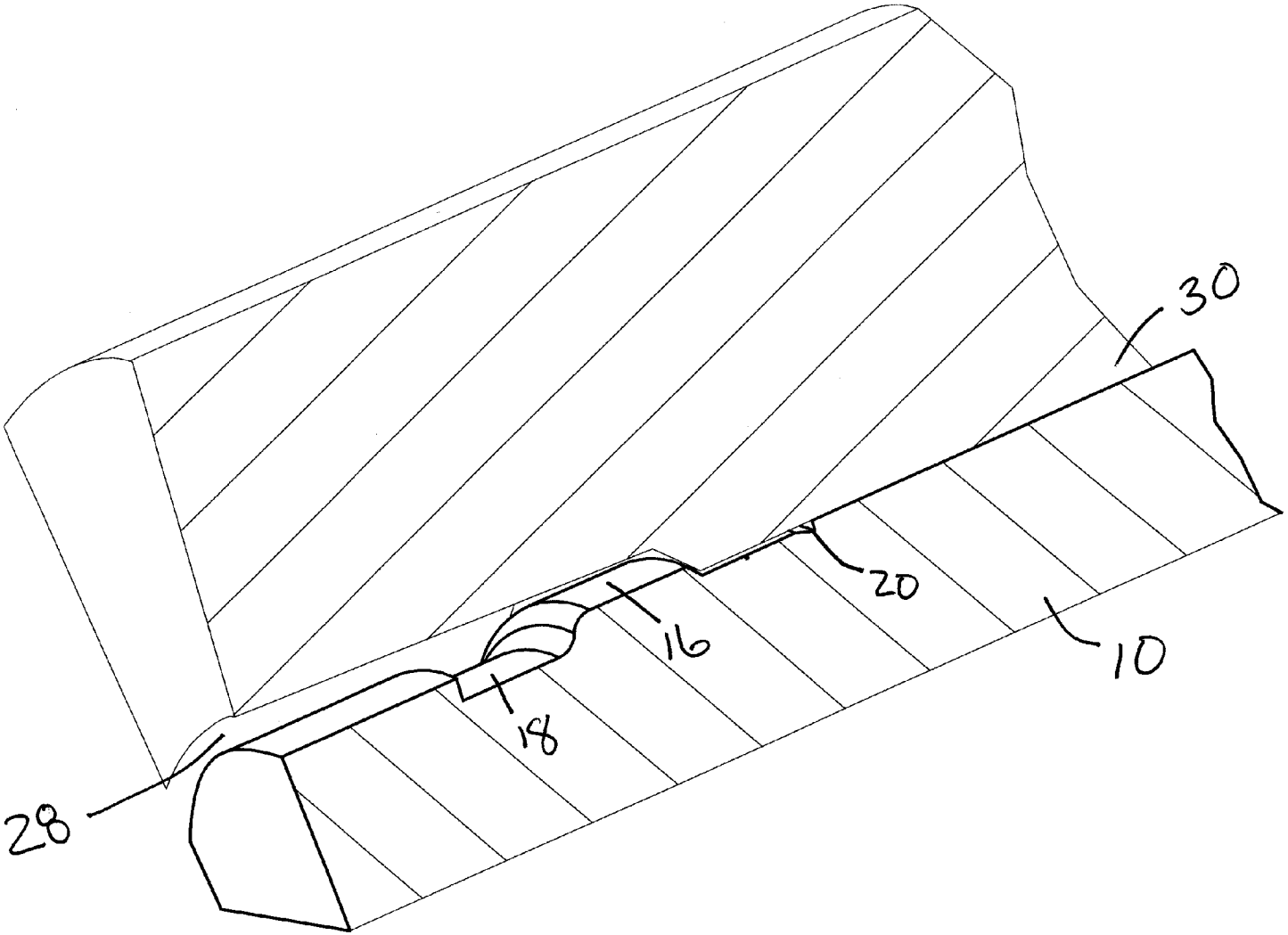
FIG. 8 is a perspective cutaway view of a self sealing projectile in a firearm according to the present invention.
Figure 9:
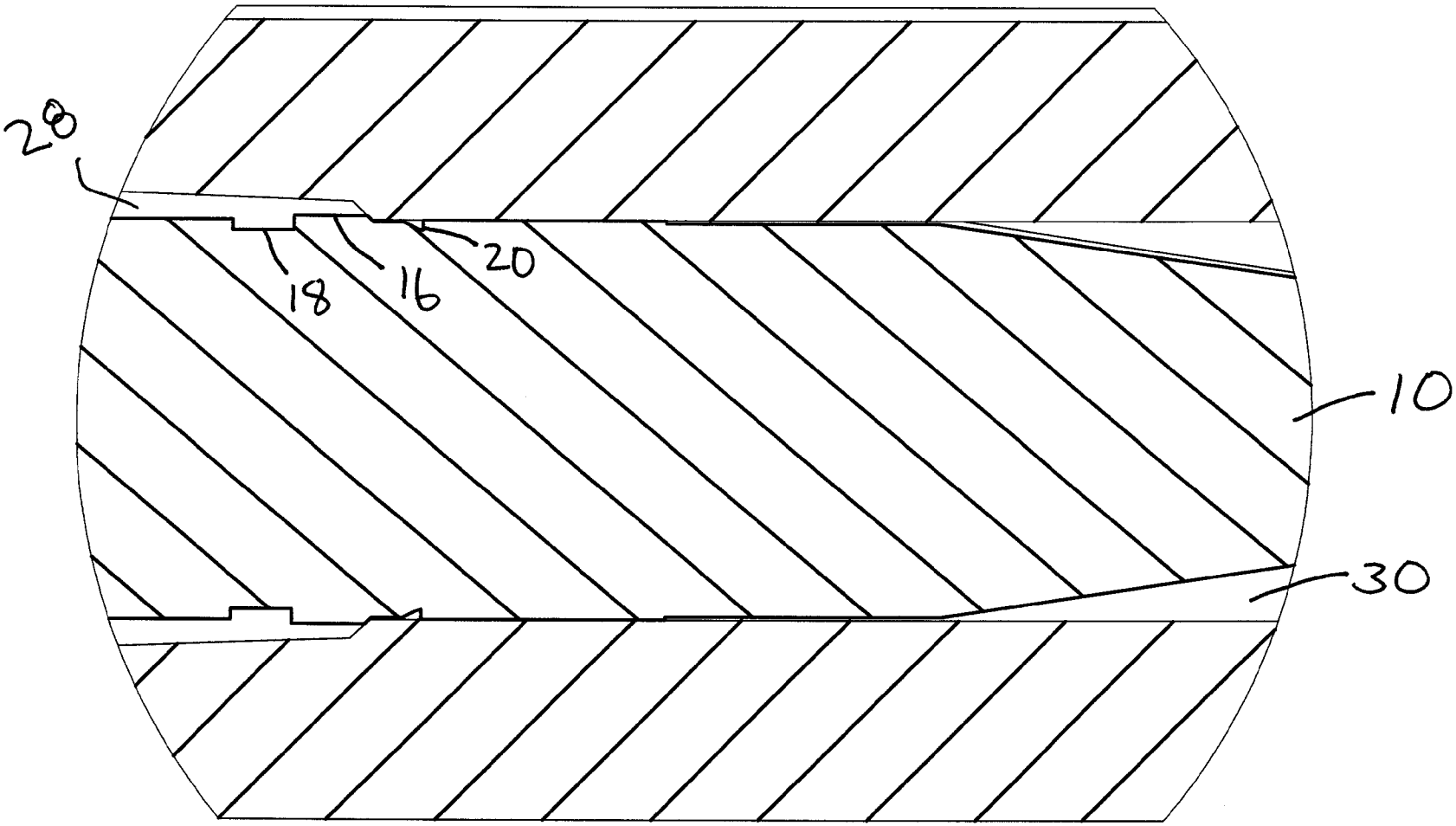
FIG. 9 is a cross sectional view of a self sealing projectile in a firearm according to the present invention.
Figure 10:
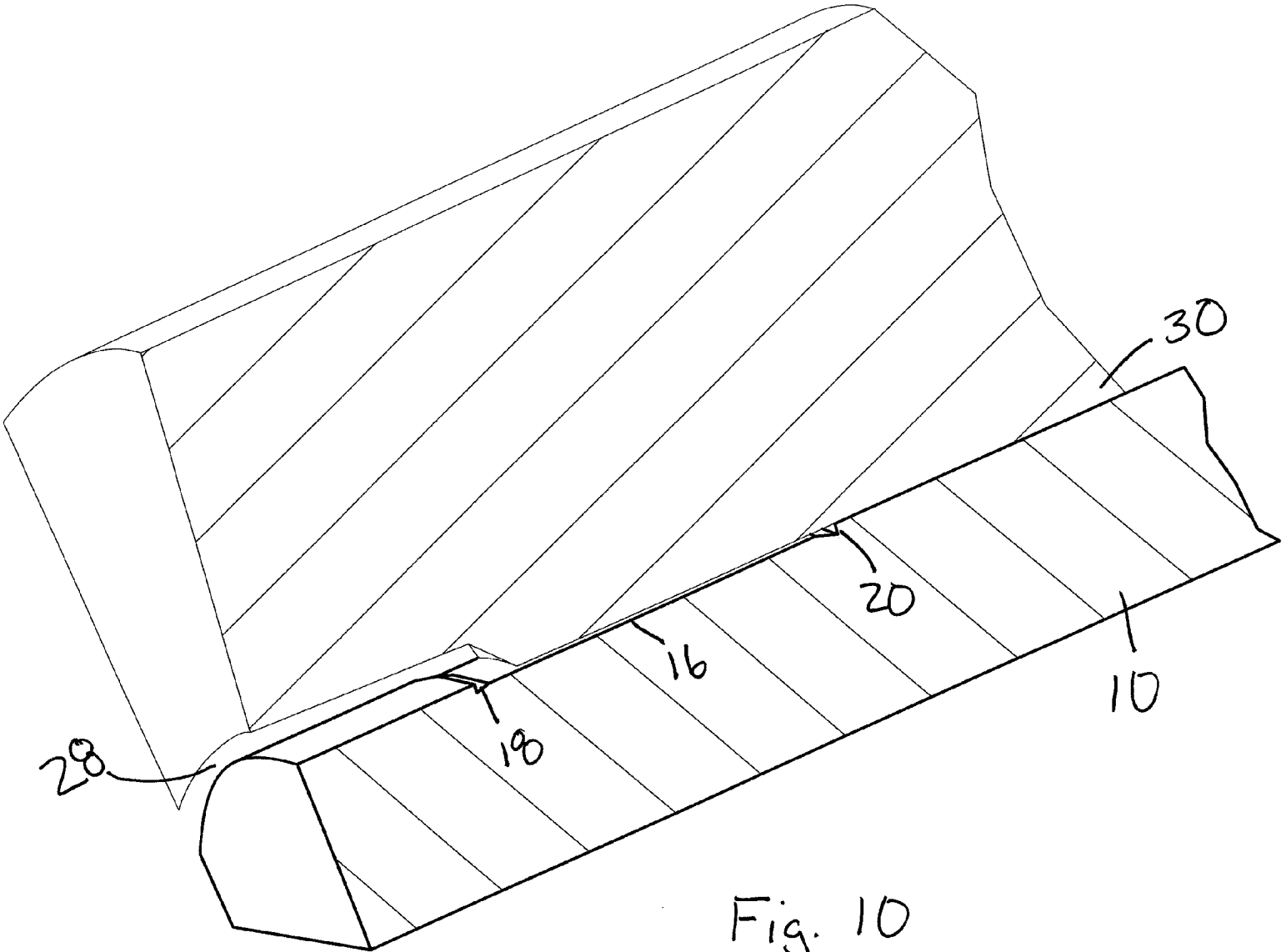
FIG. 10 is a perspective cutaway view of a self sealing projectile in a firearm according to the present invention.
Figure 11:
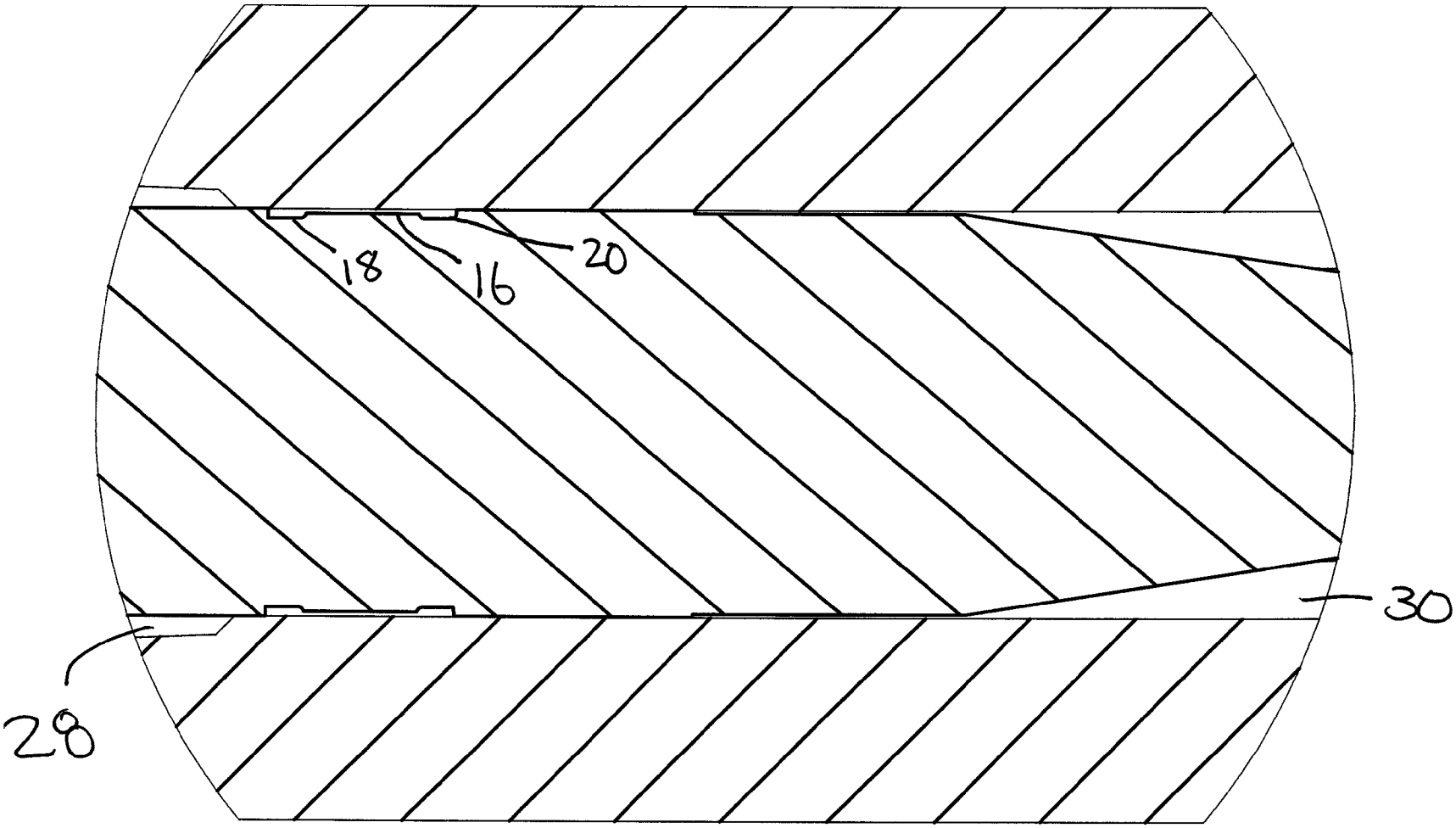
FIG. 11 is a cross sectional view of a self sealing projectile in a firearm according to the present invention.

As the self sealing projectile 10 moves forward into the rifled barrel 30, the self sealing projectile 10 starts spinning, whereby the adjustable sealing band 16 engages the lands 32 and the grooves 34. The adjustable sealing band 16 is larger in diameter than the groove diameter of the rifled barrel 28 and deforms to fit into the grooves 34 to provide a seal between the self sealing projectile 10 and the grooves 34. The groove diameter is combination of all of the bottoms of the grooves 34 around the circular diameter of the rifled barrel 28. The material of the adjustable sealing band 16 that does not fit into the grooves 34, as the adjustable sealing band 16 deforms to fit into the grooves 34, is then displaced into the rear receiving groove 18 and the front receiving groove 20. At the same time the adjustable sealing band 16 engages the grooves 34, the adjustable sealing band 16 also engages the lands 32. The adjustable sealing band 16 will deform to seal against the lands 32 and the excess material of the adjustable sealing band 16 will also be displaced into the rear receiving groove 18 and the front receiving groove 20. The self sealing projectile 10 then continues the entire length of the rifled barrel 28 with a seal between the self sealing projectile 10 and the inside of the rifled barrel 28, thereby preventing any gasses from escaping from around the self sealing projectile 10 that may cause inaccuracies and loss of potential speed of the self sealing projectile 10. FIG. 4 shows a three dimensional cutaway of a firearm with the self sealing projectile 10 and adjustable sealing band 16 in the rifled barrel 30. FIG. 5 shows a two dimensional view of FIG. 4. FIG. 6 shows a three dimensional cutaway of the adjustable sealing band 16 in the throat area 28 before the adjustable sealing band 16 makes contact with any surfaces of the firearm. FIG. 7 shows a two dimensional view of FIG. 6. FIG. 8 shows a three dimensional cutaway of the adjustable sealing band 16 as the adjustable sealing band 16 enters the rifled barrel 30 and is partially deformed due to contact with the grooves and lands of the rifled barrel 30. The adjustable sealing band 16 begins to deform towards the rear receiving groove 18 and the front receiving groove 20. FIG. 9 shows a two dimensional view of FIG. 8. FIG. 10 shows a three dimensional cutaway of the adjustable sealing band 16 fully within the rifled barrel 30 and fully deformed due to contact with the grooves and lands of the rifled barrel 30. The adjustable sealing band 16 has deformed and the excess has moved into the rear receiving groove 18 and the front receiving groove 20. FIG. 11 shows a two dimensional view of FIG. 10.

Figure 12:
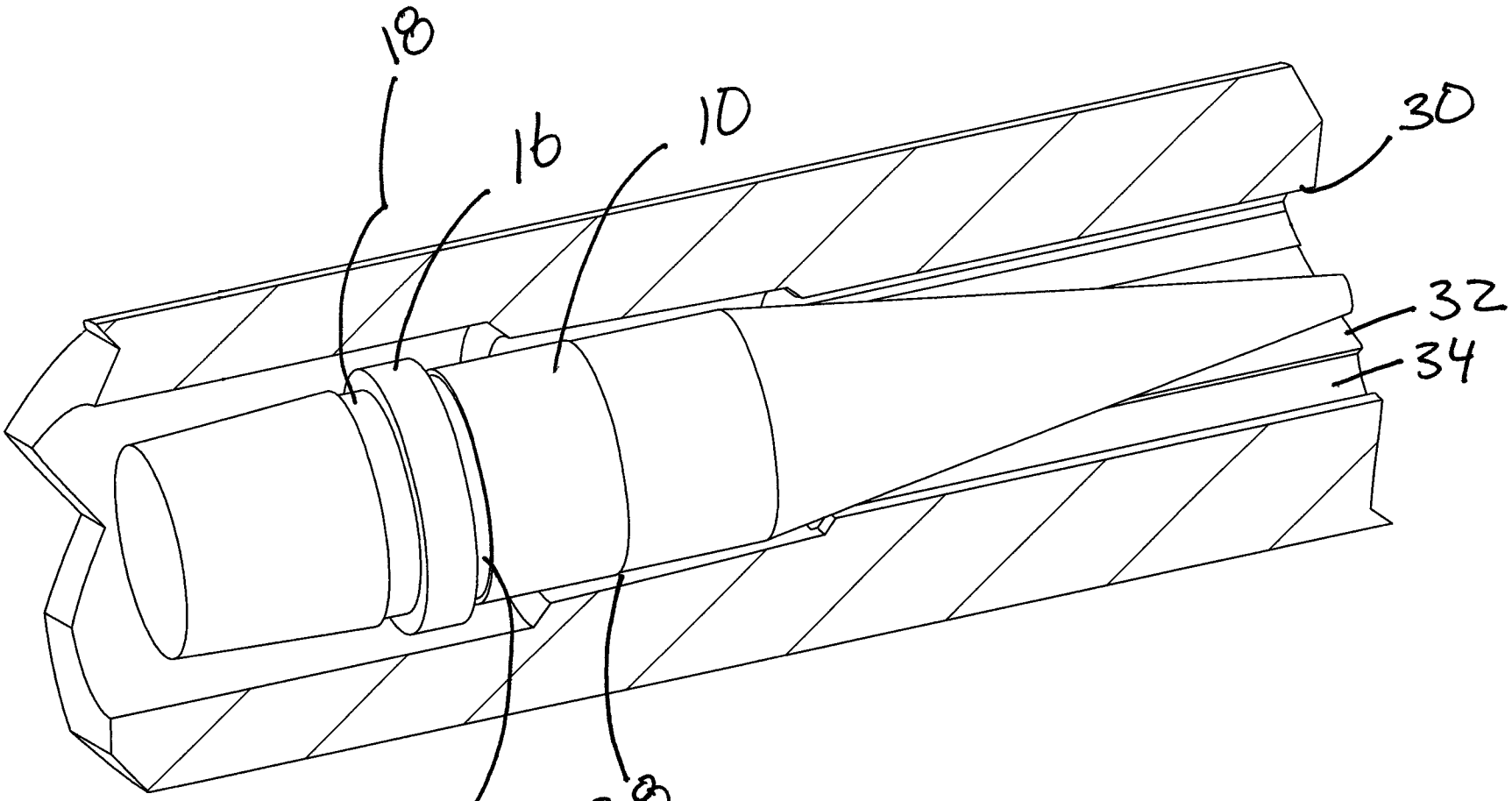
FIG. 12 is a perspective cutaway view of a self sealing projectile in a firearm according to the present invention.
Figure 13:
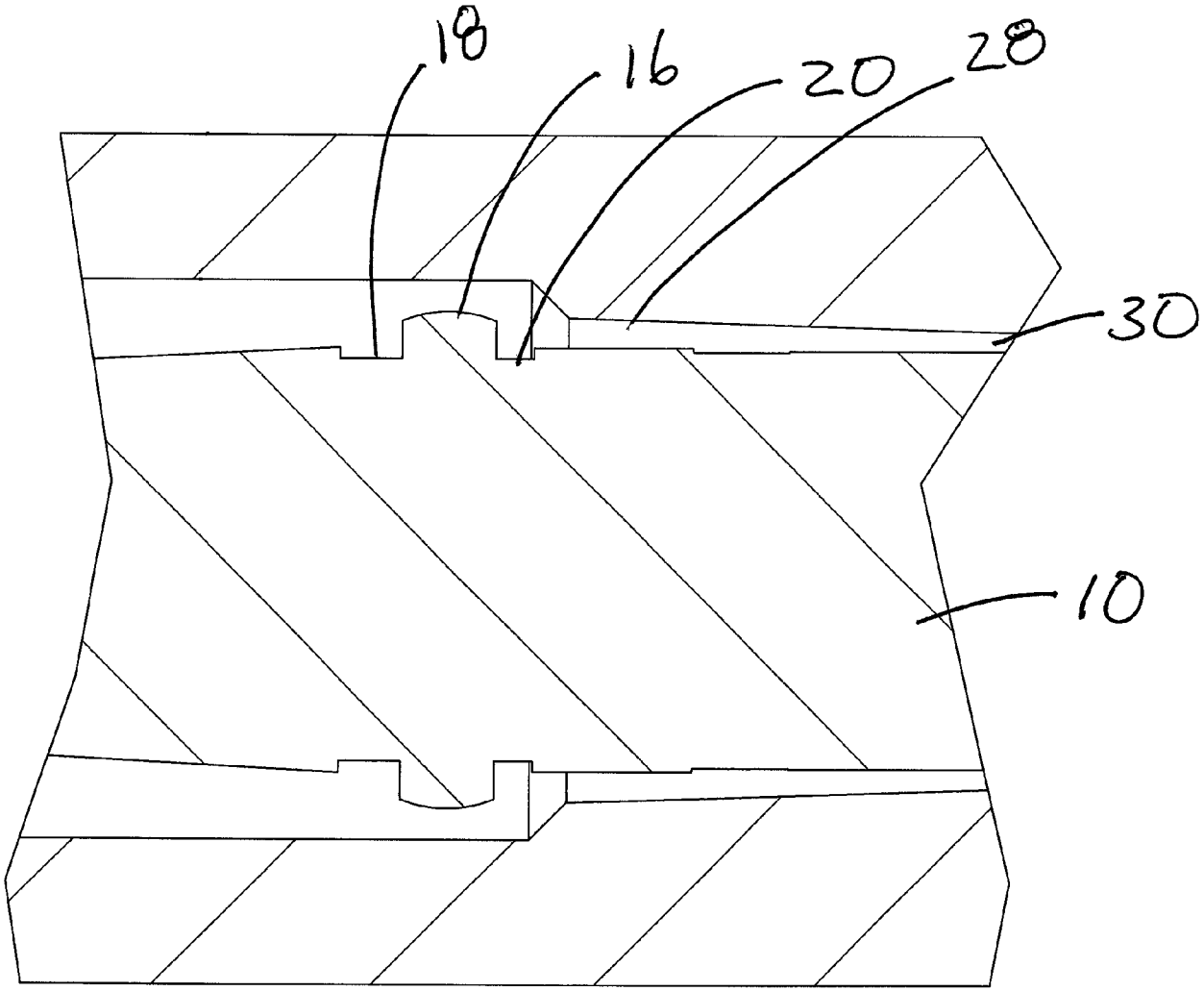
FIG. 13 is a cross sectional view of a self sealing projectile in a firearm according to the present invention.
Figure 14:
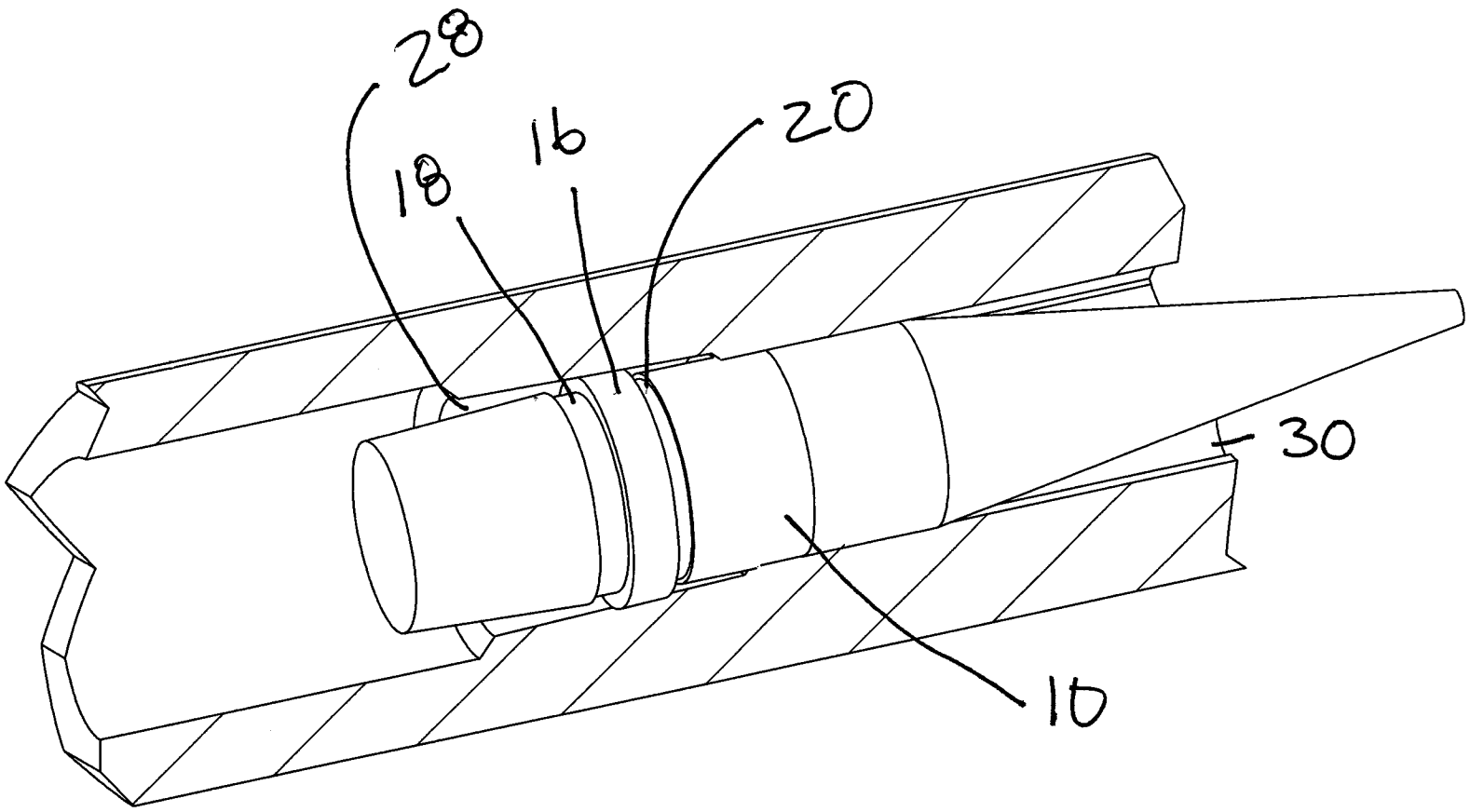
FIG. 14 is a perspective cutaway view of a self sealing projectile in a firearm according to the present invention.
Figure 15:
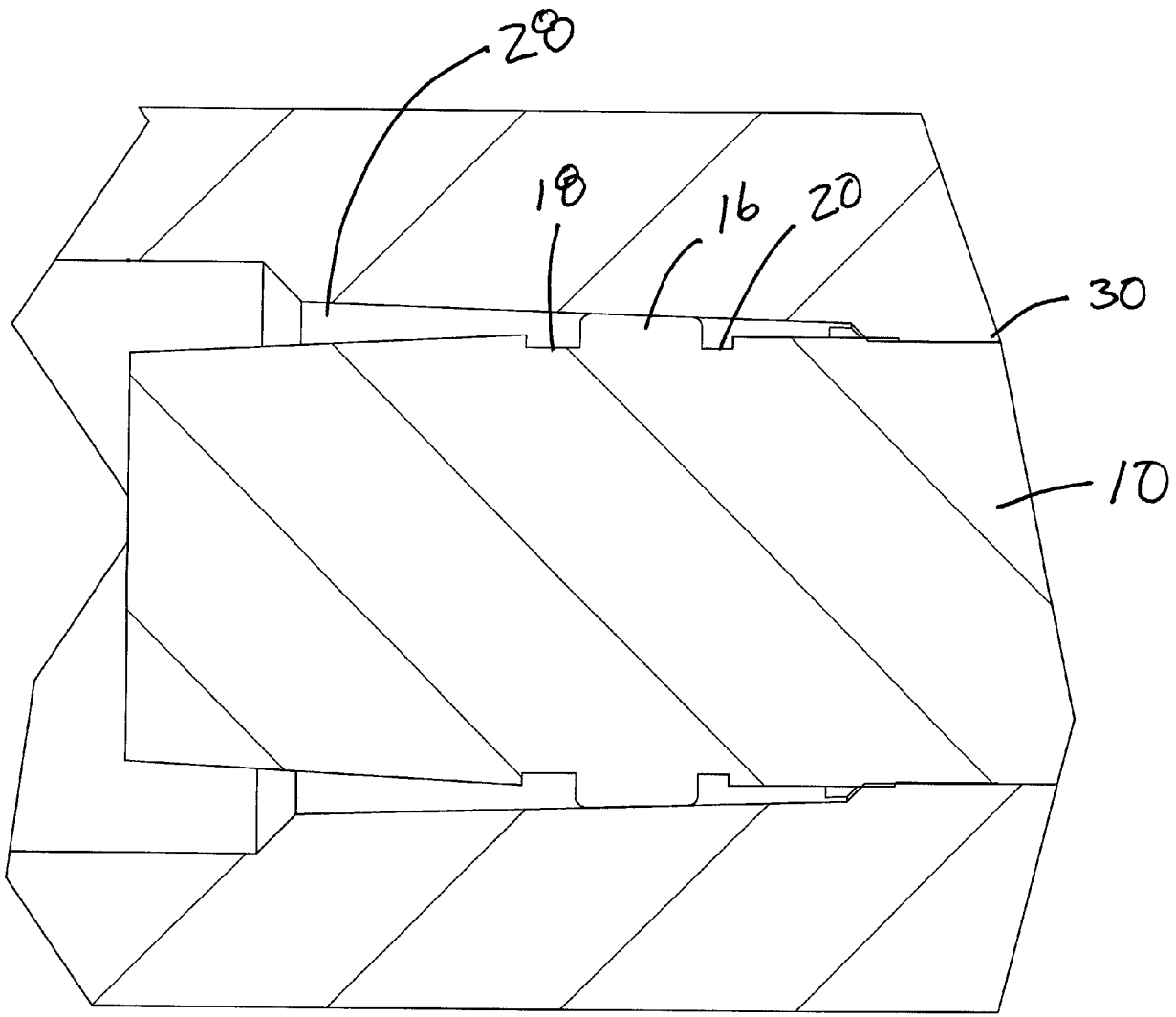
FIG. 15 is a cross sectional view of a self sealing projectile in a firearm according to the present invention.
Figure 16:
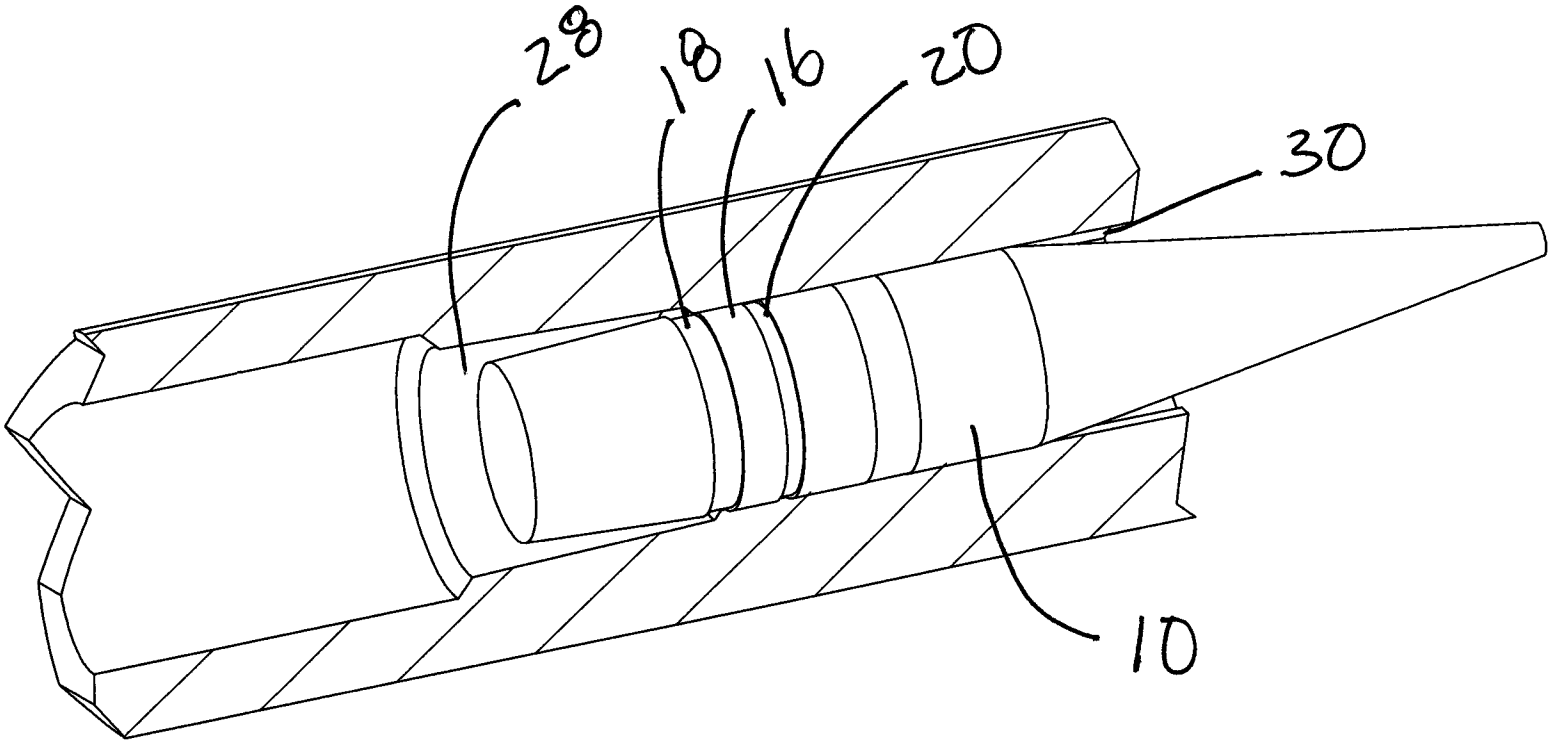
FIG. 16 is a perspective cutaway view of a self sealing projectile in a firearm according to the present invention.

The second situation is where manufacturing tolerances are tighter and the adjustable sealing band 16 contacts the throat area 28 inside the firearm. Upon firing the firearm, the self sealing projectile 10 moves forward and the adjustable sealing band 16 enters the throat area 28 of the firearm chamber. The adjustable sealing band 16 is usually between 0.0002-0.006 inches larger than the caliber diameter of the self sealing projectile 10, so very little material gets displaced into the rear receiving groove 18 and the front receiving groove 20. Assuming the diameter of the throat area 28 is small in the range of less than 0.002 inches larger than the caliber diameter band, an immediate seal takes place in the throat area 28 as the adjustable sealing band 16 enters the throat area 28, with any excess material on the adjustable sealing band 16 being displaced into the rear receiving groove 18 and the front receiving groove 20. FIG. 12 shows the adjustable sealing band 16 prior to entering the throat area 28, where the adjustable sealing band 16 will make contact due to the diameter size of the throat area 28. FIG. 13 shows a cross sectional view of the self sealing projectile 10 shown in FIG. 12. FIG. 14 shows the adjustable sealing band 16 after it has made contact with the surface of the throat area 28 and deformed due to contact of the adjustable sealing band 16 with the throat area 28. FIG. 15 shows a cross sectional view of the self sealing projectile 10 shown in FIG. 14, where the adjustable sealing band 16 has deformed and material of the adjustable sealing band 16 moves toward and into the rear receiving groove 18 and the front receiving groove 20. FIG. 16 shows the adjustable sealing band 16 after the self sealing projectile 10 has begun to enter the rifled barrel 30 and the adjustable sealing band 16 has been deformed by the rifled barrel 30. Once the adjustable sealing band 16 enters the rifled barrel 30, as shown in FIG. 16, the process shown in FIGS. 8-11 occurs.

Due to the ductility and formable nature of the copper and copper alloys, these materials allow deformation of the adjustable sealing band 16, without causing excessive pressures or wear on the firearm. It is envision that more than one adjustable sealing band 16 can be on the self sealing projectile 10, each adjustable sealing band 16 including a rear receiving groove 18 and the front receiving groove 20. While different embodiments of the invention have been described in detail herein, it will be appreciated by those skilled in the art that various modifications and alternatives to the embodiments could be developed in light of the overall teachings of the disclosure. Accordingly, the particular arrangements are illustrative only and are not limiting as to the scope of the invention that is to be given the full breadth of any and all equivalents thereof.

I claim:

1. A self sealing projectile adapted for use with a cartridge in a firearm with a barrel, consisting of:

a projectile having a front end and a rear end, said projectile having a designated caliber, said front end designated to travel first through the barrel, said rear end designated for mounting in the cartridge;

an adjustable sealing band about said projectile between said front end and said rear end; said adjustable sealing band being sized greater than said designated caliber and thus configured to deform and provide a seal between inside surfaces of the firearm and said projectile;

a front receiving groove between said adjustable sealing band and said front end of said projectile, said front receiving groove in proximity to said adjustable sealing band to receive a portion of said adjustable sealing band during deformation of said adjustable sealing band; and a rear receiving groove between said adjustable sealing band and said rear end of said projectile, said rear receiving groove in proximity to said adjustable sealing band to receive a portion of said adjustable sealing band during deformation of said adjustable sealing band; and wherein said projectile, said adjustable sealing band, said front receiving groove and said rear receiving groove are formed from one piece of solid material.

2. The self sealing projectile of claim 1, wherein said projectile, said adjustable sealing band, said front receiving groove and said rear receiving groove are formed from copper.

3. The self sealing projectile of claim 1, wherein said projectile, said adjustable sealing band, said front receiving groove and said rear receiving groove are formed from a copper alloy.

4. The self sealing projectile of claim 1, wherein said adjustable sealing band is larger than the designated caliber in a range between 0.0002 and 0.006 of an inch.

5. The self sealing projectile of claim 1, wherein said adjustable sealing band is large enough to deform in a throat area of the firearm.

6. The self sealing projectile of claim 1, wherein said adjustable sealing band is large enough to deform in a barrel of the firearm that is oversized for its stated caliber.

7. The self sealing projectile of claim 1, wherein said adjustable sealing band is large enough to deform in grooves of a rifled barrel the firearm that is oversized for its stated caliber.

8. The self sealing projectile of claim 1, wherein said front receiving groove and said rear receiving groove each extend directly from said adjustable sealing band.

9. The self sealing projectile of claim 1, wherein said front receiving groove and said rear receiving groove have a width in a range between 0.010 and 0.050 inches wide.

10. The self sealing projectile of claim 1, wherein said front receiving groove and said rear receiving groove have a depth in a range between 0.002 and 0.010 inches smaller than said adjustable sealing band.

11. A method of sealing a solid bullet made from one piece of solid material against an inside surface of grooves and lands of a rifled barrel of a firearm during firing consisting of:

providing a sealing band formed from the solid material on the bullet that is larger than the caliber diameter of the bullet and can deform to a shape of the grooves and lands, the sealing band being sized greater than the designated caliber and thus configured to deform and provide a seal between inside surfaces of the firearm and the bullet;

providing a front receiving groove in front of the sealing band to receive excess material from the sealing band as the sealing band deforms to a shape of the grooves and lands;

providing a rear receiving groove to a rear of the sealing band to receive excess material from the sealing band as the sealing band deforms to a shape of the grooves and lands; and firing the bullet in the firearm.

12. The method of claim 11, wherein the step of providing a sealing band provides a sealing band that is larger enough to engage a throat area of the firearm and deforms against the throat area to provide a seal between the sealing band and the throat area before the bullet enters the rifled barrel during firing.

13. A method of making a self sealing projectile from a solid material, consisting of:

turning a solid material into a bullet of a designated caliber;

during turning allowing a sealing band in a range of 0.0002 to 0.006 larger than the designated caliber to remain between a front and rear of the bullet, the sealing band being sized greater than the designated caliber and thus configured to deform and provide a seal between inside surfaces of the firearm and the projectile;

turning a front receiving groove in front of the sealing band; and turning a rear receiving groove to a rear of the sealing band.

* * * * *